US007543706B2

(12) United States Patent
Huang et al.

(10) Patent No.: US 7,543,706 B2
(45) Date of Patent: Jun. 9, 2009

(54) CUSHION UNIT HAVING REINFORCING CORNER PLATES

(75) Inventors: Chih Chia Huang, Taipei (TW); Po Yu Cheng, Taipei (TW)

(73) Assignee: Lite-On Technology Corp., Taipei (TW)

( * ) Notice: Subject to any disclaimer, the term of this patent is extended or adjusted under 35 U.S.C. 154(b) by 307 days.

(21) Appl. No.: 11/723,902

(22) Filed: Mar. 22, 2007

(65) Prior Publication Data

US 2008/0164401 A1 Jul. 10, 2008

(30) Foreign Application Priority Data

Jan. 10, 2007 (TW) ..... 96200484 U

(51) Int. Cl.
*B65D 81/02* (2006.01)

(52) U.S. Cl. ..... 206/523; 206/586; 206/594

(58) Field of Classification Search ..... 206/320, 206/576, 523, 586, 591, 592, 594; 248/345.1
See application file for complete search history.

(56) References Cited

U.S. PATENT DOCUMENTS 4,127,192 A * 11/1978 Card ..... 206/586
5,692,618 A * 12/1997 Beak ..... 206/586
5,720,094 A * 2/1998 Carter et al. ..... 29/446
7,383,952 B2 * 6/2008 Kruelle et al. ..... 206/453
2005/0241979 A1 * 11/2005 Manuel et al. ..... 206/523

* cited by examiner

*Primary Examiner*—Jacob K Ackun Jr.
(74) *Attorney, Agent, or Firm*—Rosenberg, Klein & Lee

(57) ABSTRACT

A cushion unit includes a frame having a plurality of corners, and a plurality of reinforcing corner plates respectively disposed in the corners. Each reinforcing corner plate has two main portions angled to each other to form a substantially L-shape, and two wing portions projecting respectively from the main portions. Each corner has two adjacent corner wall sections respectively formed with first engaging grooves for engagement with the wing portions of the respective reinforcing corner plate. The main portions of the reinforcing corner plates are disposed respectively on inner sides of the corner wall sections of the corners when the wing portions of the reinforcing corner plates engage respectively the first engaging grooves in the corner wall sections.

9 Claims, 3 Drawing Sheets

CUSHION UNIT HAVING REINFORCING CORNER PLATES

CROSS-REFERENCE TO RELATED APPLICATION

This application claims priority of Taiwanese Application No. 096200484, filed on Jan. 10, 2007.

BACKGROUND OF THE INVENTION

1. Field of the Invention

The invention relates to a cushion unit, more particularly to a cushion unit that has reinforcing corner plates.

2. Description of the Related Art

FIG. 1 illustrates a currently available cushion unit 9 used for packing a large electronic product, such as a computer module, a server, etc. The cushion unit 9 has a surrounding wall 91, and two rear walls 92 connected to a rear side of the surrounding wall 91, and is usually made from a foam material, such as expanded polyethylene (EPE), expanded polystyrene (EPS), etc. By using two cushion units 9, eight corners of a rectangular article (not shown) can be covered so as to protect the article from damage due to impact during transport. In order to absorb the impact when a large article falls to the ground or is suddenly struck by another object during transport, the surrounding wall 91 and the rear walls 92 of the cushion unit 9 must have considerable thicknesses in order to sufficiently absorb shock and achieve a buffering effect. Hence, the volume of an entire packaging body is increased, such that the quantity of products packed by the packaging body that may be fitted in a container is reduced. As such, the cost of transporting the products is increased.

SUMMARY OF THE INVENTION

Therefore, the object of the present invention is to provide a cushion unit that is capable of overcoming the aforementioned drawbacks of the prior art.

According to this invention, a cushion unit comprises a frame having a plurality of corners, and a plurality of reinforcing corner plates respectively disposed in the corners. Each of the reinforcing corner plates has two main portions angled to each other to form a substantially L-shape, and two wing portions projecting respectively from the main portions. Each of the corners has two adjacent corner wall sections respectively formed with first engaging grooves for engagement with the wing portions of a respective one of the reinforcing corner plates. The main portions of the reinforcing corner plates are disposed respectively on inner sides of the corner wall sections of the corners when the wing portions of the reinforcing corner plates engage respectively the first engaging grooves in the corner wall sections.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
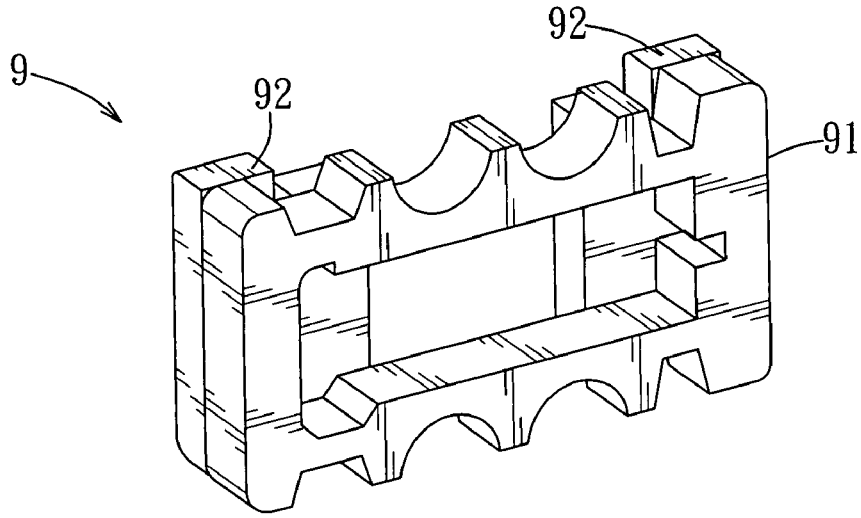
FIG. 1 PRIOR ART
FIG. 1 is a perspective view of a currently available cushion unit.

Before the present invention is described in greater detail, it should be noted that the same reference numerals have been used to denote like elements throughout the specification.

Figure 2:
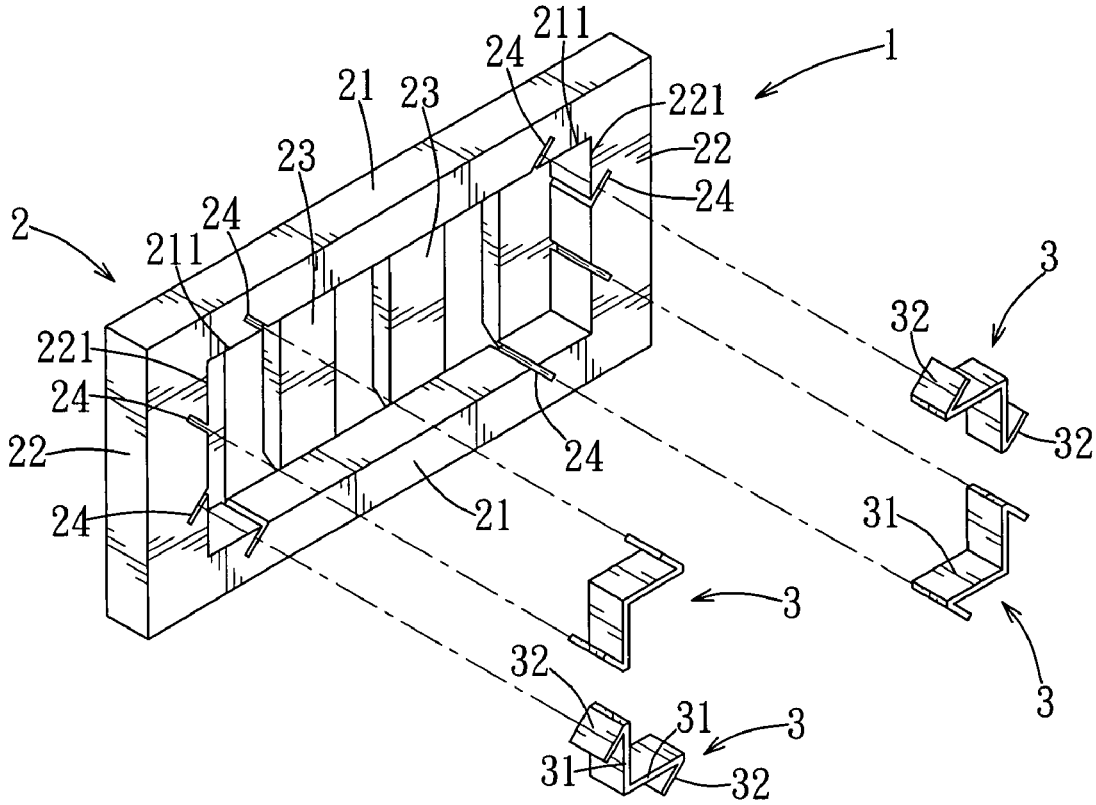
FIG. 2 is an exploded perspective view of the first preferred embodiment of a cushion unit according to the present invention.
Figure 3:
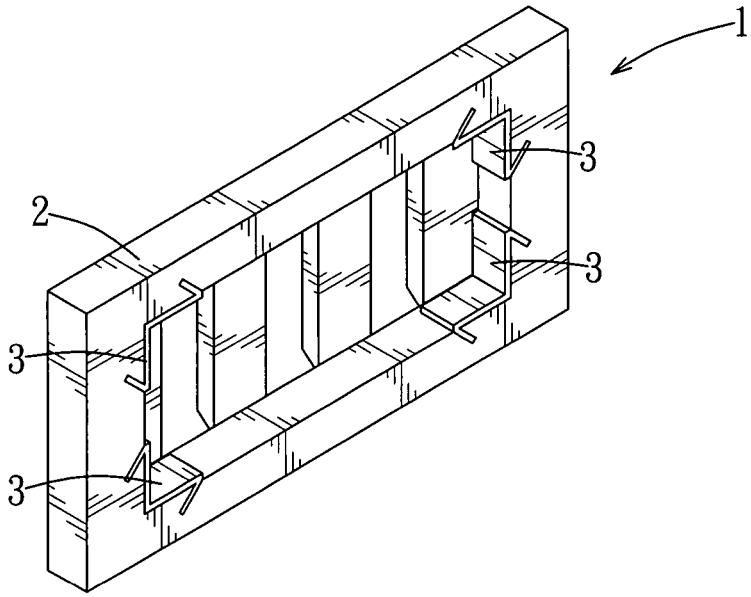
FIG. 3 is an assembled perspective view of the first preferred embodiment.

Referring to FIGS. 2 and 3, the first preferred embodiment of a cushion unit 1 according to the present invention is shown to comprise a rectangular frame 2 and four reinforcing corner plates 3.

The rectangular frame 2 has a pair of spaced-apart first sidewalls 21 extending horizontally, a pair of second sidewalls 22 respectively connected to left and right ends of the first sidewalls 21 and extending uprightly, and four spaced-apart upright third sidewalls 23 each having two opposite ends connected respectively to the first sidewalls 21. The first and second sidewalls 21, 22 form four corners of the frame 2.

The reinforcing corner plates 3 are respectively disposed in the four corners of the frame 2. Each reinforcing corner plate 3 has two main portions 31 angled to each other to form a substantially L-shape, and two wing portions 32 projecting respectively from free ends of the main portions 31. Each of the main portions 31 and the respective wing portion 32 define therebetween an angle of about 30-90°.

Each corner of the frame 2 has two adjacent corner wall sections 211, 221 defining a right angle therebetween and respectively formed with first engaging grooves 24 that correspond to and that engage the wing portions 32 of the respective reinforcing corner plate 3. With the wing portions 32 of the reinforcing corner plates 3 engaged respectively to the first engaging grooves 24 in the corner wall sections 211, 221 of the corners of the frame 2, the reinforcing corner plates 3 are fixed to the respective corners of the frame 2. The main portions 31 of the reinforcing corner plates 3, at this time, are located respectively on inner sides of the corner wall sections 211, 221 of the corners of the frame 2.

Figure 4:
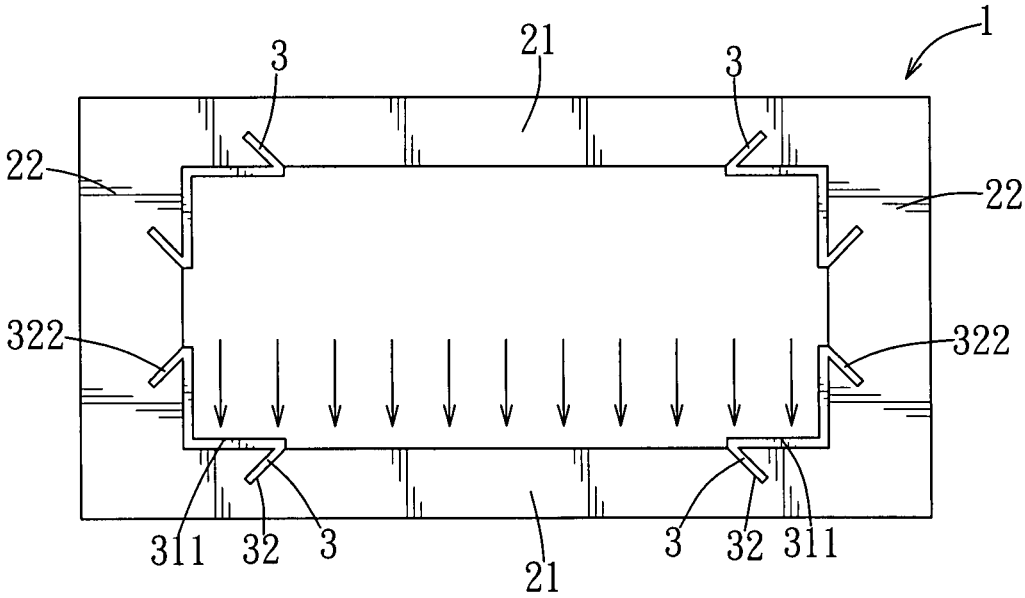
FIG. 4 is a schematic view of the first preferred embodiment, conceptually illustrating downward forces acting on a sidewall of the cushion unit of the present invention.

When the main portions 31 of the reinforcing corner plates 3 on the lower first sidewall 21 receive normal impact forces (represented by a plurality of arrows shown in FIG. 4), the main portions 31 that lie horizontally (particularly shown at 311 in FIG. 4) will move in the same direction as the impact forces, thereby pulling the wing portions 32 that engage the respective second sidewalls 22 (particularly shown at 322 in FIG. 4). As such, portions of the impact forces directed at the first sidewall 21 are distributed to the two adjacent second sidewalls 22. That is, the impact forces are not concentrated fully on the single first sidewall 21, and are, rather, spread out also onto the second sidewalls 22. By adjusting the angle between the wing portion 32 and the respective main portion 31, different pulling forces can be produced. The smaller the angle, the greater is the pulling force. Since the reinforcing corner plates 3 can lessen the forces impacting on each of the first and second sidewalls 21, 22 and can strengthen the corners of the frame 2, the thickness required for the first and second sidewalls 21, 22 can be decreased, which results in reducing the volume of the cushion unit 1.

The frame 2 of the cushion unit 1 can be made of a commonly used cushion material, such as expanded polyethylene (EPE) or expanded polystyrene (EPS). In this embodiment, the frame 2 is made of EPE. Each of the reinforcing corner plates 3 can be made from corrugated paper or plastic that is formed into a resilient plate. In this embodiment, each reinforcing corner plate 3 is made of a corrugated paper plate. The corrugated paper plate is cut into appropriate dimensions, after which it is bent and folded to take the shape of the reinforcing corner plate 3 of the present invention.

Figure 5:
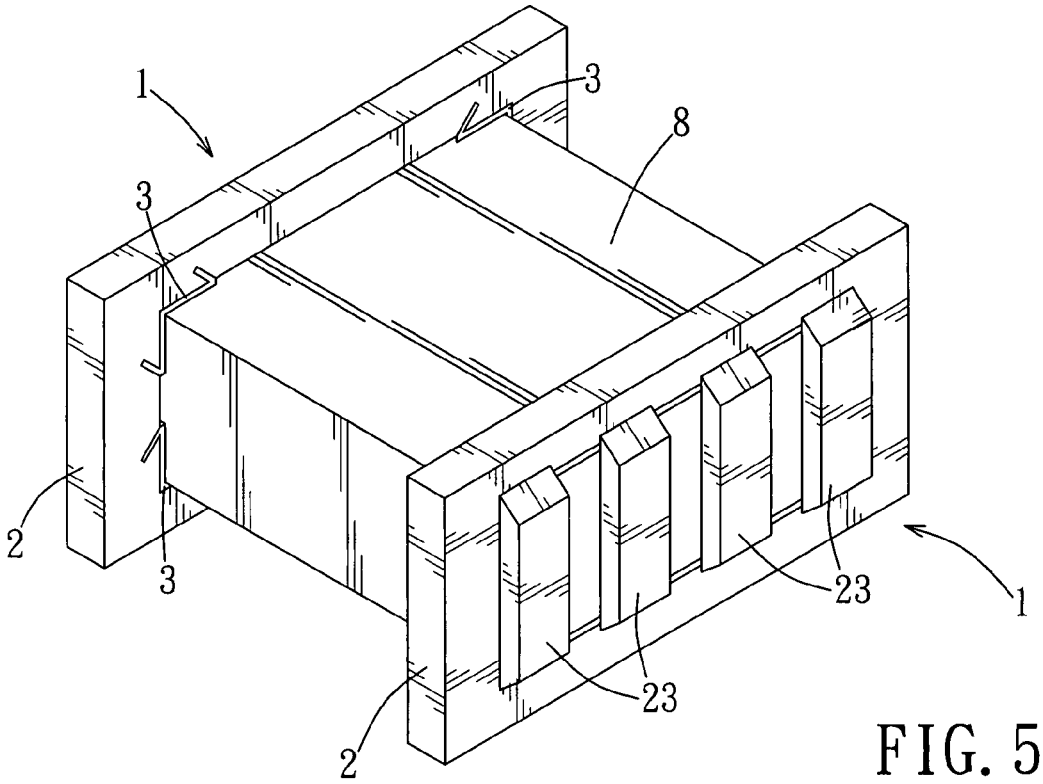
FIG. 5 illustrates the first preferred embodiment in a state of use.

Referring to FIG. 5, a pair of the cushion units 1 is used to pack an article 8. The third sidewalls 23 of the frames 2 of the cushion units 1 ensure that the frames 2 are positioned on eight corners of the article 8 in a state where the cushion units 1 are positioned to protect six faces of the article 8. When the article 8 and the cushion units 1 are placed together in a box (not shown), the article 8 will not be in direct contact with the box.

Figure 6:
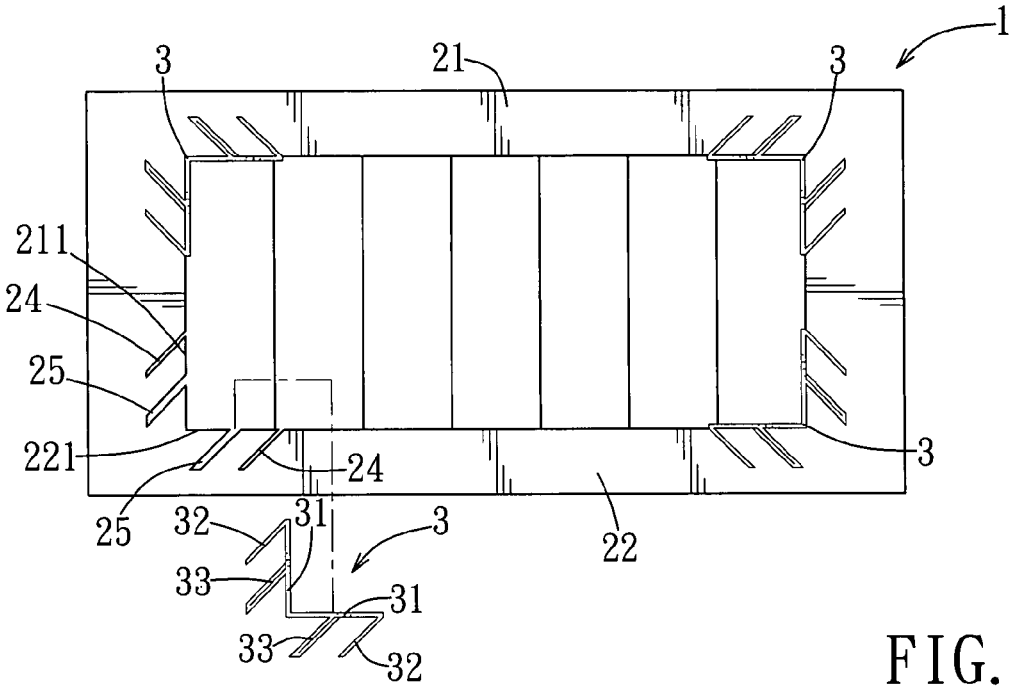
FIG. 6 is a schematic view of a cushion unit according to the second preferred embodiment of the present invention.

Referring to FIG. 6, the cushion unit 1 according to the second preferred embodiment of the present invention is shown to be similar to the first preferred embodiment. However, in this embodiment, each of the reinforcing corner plates 3 further has two auxiliary wing portions 33 each extending from the respective main portion 31 and spaced apart from the adjacent wing portion 32. The corner wall sections 211, 221 of each corner of the frame 2 are further formed respectively with second engaging grooves 25 to engage the respective auxiliary wing portions 33. The auxiliary wing portions 33 of each reinforcing corner plate 3 are used to enhance the distribution of forces acting on any one side of the frame 2. Depending on the requirements, one or a plurality of the auxiliary wing portions 33 may be formed on one of the main portions 31 of each reinforcing corner plate 3. In this embodiment, the same piece of paper in the form of a plate is bent and folded to form the main portions 31, the wing portions 32, and the auxiliary wing portions 33. Since each of the auxiliary wing portions 33 is formed of two stacked plate parts, the thickness of each auxiliary wing portion 33 is twice that of the respective wing portion 32. Alternatively, the auxiliary wing portions 33 may be formed by cutting a separate paper plate, after which the auxiliary wing portions 33 are adhered or engaged to the paper plate that is formed into the main portions 31 and the wing portions 32. If a plastic plate is used, then a conventional plastic forming method may be employed.

From the aforementioned description, it is apparent that the cushion unit 1 of the present invention uses the reinforcing corner plates 3 to disperse impact forces, so that the thickness of the frame 2 can be reduced, thereby minimizing the volume of the cushion unit 1. This further results in increasing the quantity of the article 8 that can be loaded in a container, so that transport costs are greatly minimized.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A cushion unit comprising:

a frame having a plurality of corners; and a plurality of reinforcing corner plates respectively disposed in said corners, each of said reinforcing corner plates having two main portions angled to each other to form a substantially L-shape, and two wing portions projecting respectively from said main portions;

wherein each of said corners has two adjacent corner wall sections respectively formed with first engaging grooves for engagement with said wing portions of a respective one of said reinforcing corner plates, said main portions of said reinforcing corner plates being disposed respectively on inner sides of said corner wall sections of said corners when said wing portions of said reinforcing corner plates engage respectively said first engaging grooves in said corner wall sections.

2. The cushion unit of claim 1, wherein each of said wing portions projects from a free end of the respective one of said main portions.

3. The cushion unit of claim 2, wherein each of said main portions and the respective one of said wing portions define therebetween an angle of about 30-90°.

4. The cushion unit of claim 1, wherein each of said reinforcing corner plates further includes at least one auxiliary wing portion extending from at least one of said main portions and spaced apart from an adjacent one of said wing portions, said frame further having a second engaging groove to engage said auxiliary wing portion.

5. The cushion unit of claim 1, wherein said frame is made of a foam material.

6. The cushion unit of claim 5, wherein said foam material is expanded polyethylene (EPE).

7. The cushion unit of claim 5, wherein said foam material is expanded polystyrene (EPS).

8. The cushion unit of claim 1, wherein each of said reinforcing corner plates is made from corrugated paper.

9. The cushion unit of claim 1, wherein each of said reinforcing corner plates is made from plastic.

* * * * *